US008270330B1

(12) United States Patent
Olding et al.

(10) Patent No.: US 8,270,330 B1
(45) Date of Patent: Sep. 18, 2012

(54) SYSTEM AND METHOD FOR COMMUNICATING MEDIA DATA WITH TARGETED ADVERTISING TO A MOBILE DEVICE

(75) Inventors: Doug A. Olding, Overland Park, KS (US); Warren B. Cope, Olathe, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 810 days.

(21) Appl. No.: 11/561,589

(22) Filed: Nov. 20, 2006

(51) Int. Cl.
*H04H 20/71* (2008.01)

(52) U.S. Cl. ..... 370/312; 370/342; 455/414.1; 455/420

(58) Field of Classification Search ..... 370/312, 370/342; 455/414.1, 420
See application file for complete search history.

(56) References Cited

U.S. PATENT DOCUMENTS

2002/0059596 A1* 5/2002 Sano et al. ..... 725/39
2002/0087656 A1* 7/2002 Gargiulo et al. ..... 709/217
2003/0030751 A1* 2/2003 Lupulescu et al. ..... 348/552
2003/0149988 A1* 8/2003 Ellis et al. ..... 725/87
2006/0194535 A1* 8/2006 Houldsworth et al. ..... 455/3.01
2007/0157249 A1* 7/2007 Cordray et al. ..... 725/58
2007/0196078 A1* 8/2007 Kunii et al. ..... 386/83

* cited by examiner

*Primary Examiner* — Barry W Taylor

(57) ABSTRACT

A system and methods are provided for communicating media data associated with a media host device to a mobile device and presenting the media data via the mobile device. The media data includes information associated with media content available to a media host device. The mobile device receives a request to present media data. The mobile device receives the media data from a media data source via at least one protected network. Targeted advertising may be inserted into the media data prior to delivery. The media data is presented via the mobile device.

19 Claims, 14 Drawing Sheets

SYSTEM AND METHOD FOR COMMUNICATING MEDIA DATA WITH TARGETED ADVERTISING TO A MOBILE DEVICE

CROSS-REFERENCE TO RELATED APPLICATIONS

This application is related by subject matter to the inventions disclosed in the following commonly assigned applications: U.S. application Ser. No. 11/088,615 filed on Mar. 24, 2005, entitled "SYSTEM AND METHOD FOR CONTROLLING A MEDIA HOST DEVICE USING A MOBILE DEVICE;" U.S. application Ser. No. 11/088,614, filed on Mar. 24, 2005, entitled "SYSTEM AND METHOD FOR COMMUNICATING MEDIA CONTENT TO A MOBILE DEVICE;" and U.S. application Ser. No. 11/026,979, filed on Dec. 30, 2004, entitled SYSTEM AND METHOD TO PROVIDE SERVICES FROM A COMMUNICATION NETWORK TO A MEDIA-DELIVERY NETWORK VIA A HOST DEVICE CONNECTED TO THE MEDIA-DELIVERY NETWORK" and U.S. application Ser. No. 11/088,517, filed on Mar. 24, 2005 entitled "SYSTEM AND METHOD FOR COMMUNICATING MEDIA DATA TO A MOBILE DEVICE." Each of the aforementioned applications is herein incorporated by reference in its entirety.

STATEMENT REGARDING FEDERALLY SPONSORED RESEARCH OR DEVELOPMENT

Not applicable.

TECHNICAL FIELD

This invention relates to integrating communications networks and media-delivery networks.

BACKGROUND OF THE INVENTION

Devices, commonly referred to as personal video recorders (PVRs) (or digital video recorders 'DVRs' or the like), have been developed that allow users to digitally record and store media content on hard drives or some other media. Users may program PVRs to record content, such as television shows and movies, and watch the content at a later time. If users cannot reach their PVR, they will not be able to program it or view its content. It would be advantageous if programming and retrieving media content from PVRs could be performed securely from a remote location. Offering a digital-rights-management (DRM) scheme would also be desirable. Providing targeted advertising in media delivered to a mobile device would be advantageous to network and/or content providers as well. The current state of the art could be advanced by providing the ability to program and retrieve media content from a PVR using a mobile device.

SUMMARY OF THE INVENTION

The present invention is directed to a system and methods for communicating media data associated with a media host device to a mobile device and presenting the media data via the mobile device. Thus, in one aspect, an embodiment of the present invention relates to a method for presenting media data via a mobile device. In accordance with the method, a mobile device receives a request to present media data. The media data represents information regarding media content available to a media host device. The mobile device receives the media data from a media data source via at least one protected network. The media data is presented via the mobile device.

In another aspect of the invention, an exemplary embodiment is directed to a method for communicating media data to a mobile device. In accordance with the method, a media data source receives a request to communicate media data to a mobile device. The media data represents information regarding media content available to a media host device. The media data source provides the requested media data and communicates the requested media data to the mobile device via at least one protected network.

In yet another aspect, an exemplary embodiment of the invention takes the form of a method for communicating media data from a media host device to a mobile device. The media data includes information associated with media content available to the media host device. A request for media data is received from a mobile device via at least one first protected network. The request includes at least one unique identifier. A destination address associated with the media host device is derived from the unique identifier. The request is communicated to the media host device via at least one second protected network. The requested media data is received from the media host device via the at least one second protected network and communicated to the mobile device via the at least one first protected network.

A further aspect of the invention takes the form of a system for presenting media data on a mobile device. The media data represents information regarding media content available to a media host device. The system includes a first protected network, a second protected network, and a gateway server. The first protected network has at least one mobile device coupled to it. The mobile device may request and receive media data via the first protected network. The second protected network has at least one media host device coupled to it. The media host device may receive the request for media data and communicate the requested media data via the second protected network. The gateway server is coupled to the first and to the second protected networks.

A further aspect of the present invention provides for the insertion of advertisements targeted to mobile device users. The insertion of targeted advertising may resemble targeted advertising sometimes inserted by television cable providers at a cable head end for different geographical areas of their market. In one aspect, advertisements targeted to mobile users may be inserted into media at the cable headend prior to caching the media on a media server. Alternatively, advertising targeted to mobile users may be inserted into media at a media server either prior to or during transmission of the media to a mobile user.

BRIEF DESCRIPTION OF THE SEVERAL VIEWS OF THE DRAWINGS

The present invention is described in detail below with reference to the attached drawing figures, which are incorporated by reference herein and wherein.

DETAILED DESCRIPTION OF THE INVENTION

Figure 1:
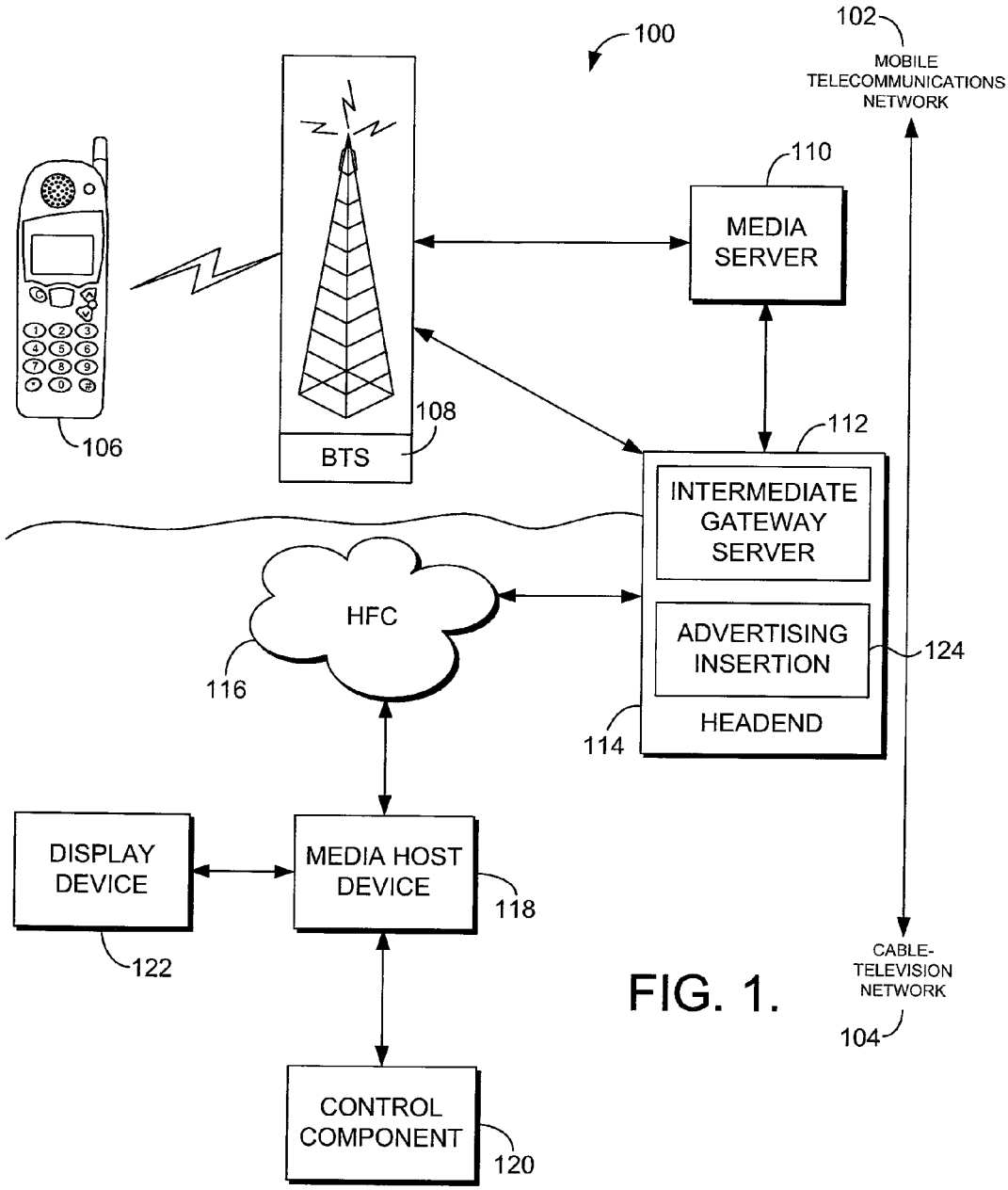
FIG. 1 is a block diagram of an exemplary system architecture suitable for use in implementing the present invention.

The present invention permits, among other things, the integration of one or more communications networks with one or more media-delivery networks. Results of the integration include the ability to: (1) communicate to a mobile device, such as a cell phone, information regarding media content available to a media host device, such as a set-top box; (2) control a media host device using a mobile device; and (3) communicate media content from a media host device to a mobile device. While the type of communications network described in detail herein is a telecommunications network, and, more particularly, a mobile telecommunications network, one skilled in the art will appreciate that the present invention may be implemented with other types of communications networks permitting the multi-directional exchange of information (in any format, including analogue). Likewise, one skilled in the art will appreciate that while a television network, and more particularly a cable-television network, is described herein as an example of a media-delivery network, the present invention may be implemented with other types of media-delivery networks that permit the substantially unidirectional delivery of media content.

A telecommunications network that provides telephone services is usually owned by a telecommunications-service provider and is separate from a television network that provides television programming and is owned by a television-service provider. In some embodiments, the present invention permits communication between a mobile device communicating on a communications network, such as a mobile telecommunications network, and a media host device communicating on a media-delivery network, such as a cable-television network, by interfacing the two networks, for example at a cable headend.

By interfacing the two networks, the present invention provides a protected communication pathway between a media host device and mobile device. Both the communications network and the media-delivery network are protected, private networks. Components within the networks and communication pathways within and between the networks are protected. Thus, any communication between a media host device and a mobile device is likewise protected. Because data and content, such as media content, is protected during communication between the media host device and the mobile device, digital rights management may be maintained.

Although there is no reason that the present invention could not be implemented in a wholly owned scenario wherein both the communications network and the media-delivery network belong to the same entity, the invention is described in detail herein for the exemplary scenario where two entities must cooperatively integrate separate networks to provide the services.

Acronyms and Shorthand Notations

Throughout the description of the present invention, several acronyms and shorthand notations are used to aid the understanding of certain concepts pertaining to the associated system and services. These acronyms and shorthand notations are solely intended for the purpose of providing an easy methodology of communicating the ideas expressed herein and are in no way meant to limit the scope of the present invention. The following is a list of these acronyms:

| | |
|---|---|
| A-Key | Authentication Key |
| BTS | Base Transceiver Station |
| DAVIC | Digital Audio Video Council |
| DOCSIS | Data Over Cable Service Interface Specification |
| DVR | Digital Video Recorder |
| ESN | Electronic Serial Number |
| HDR | Hard Disk Recorder |
| HFC | Hybrid Fiber Coaxial |
| IP | Internet Protocol |
| MAC | Media Access Control |
| MIN | Mobile Identification Number |
| NAT | Network Address Translation |
| OCAP | Open Cable Application Platform |
| PDA | Personal Data Assistant |
| PDSN | Packet Data Serving Node |
| PTR | Personal TV Receiver |
| PVR | Personal Video Recorder |
| PVS | Personal Video Station |
| RF | Radio Frequency |
| STB | Set-Top Box |
| VPN | Virtual Private Network |

Further, various technical terms are used throughout this description. A definition of such terms can be found in *Newton's Telecom Dictionary* by H. Newton, 19th Edition (2003). These definitions are intended to provide a clearer understanding of the ideas disclosed herein but are in no way intended to limit the scope of the present invention.

As one skilled in the art will appreciate, the present invention may be embodied as, among other things: a method, system, or computer-program product. Accordingly, the present invention may take the form of a hardware embodiment, a software embodiment, or an embodiment combining software and hardware. In an embodiment, the present invention takes the form of a computer-program product that includes computer-useable instructions embodied on one or more computer-readable media.

Computer-readable media include both volatile and non-volatile media, removable and nonremovable media, and contemplates media readable by a database, a switch, and various other network devices. Network switches, routers, and related components are conventional in nature, as are means of communicating with the same. By way of example, and not limitation, computer-readable media comprise computer-storage media and communications media.

Computer-storage media, or machine-readable media, include media implemented in any method or technology for storing information. Examples of stored information include computer-useable instructions, data structures, program modules, and other data representations. Computer-storage media include, but are not limited to RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These memory components can store data momentarily, temporarily, or permanently.

Communications media typically store computer-useable instructions—including data structures and program modules—in a modulated data signal. The term "modulated data signal" refers to a propagated signal that has one or more of its characteristics set or changed to encode information in the signal. An exemplary modulated data signal includes a carrier wave or other transport mechanism. Communications media include any information-delivery media. By way of example but not limitation, communications media include wired media, such as a wired network or direct-wired connection, and wireless media such as acoustic, infrared, radio, microwave, spread-spectrum, and other wireless media technologies. Combinations of the above are included within the scope of computer-readable media.

Exemplary System Architecture

Referring to FIG. 1, a block diagram is shown of an exemplary system 100 in which exemplary embodiments of the present invention may be employed. It should be understood that this and other arrangements described herein are set forth only as examples. Other arrangements and elements (e.g., machines, interfaces, functions, orders, and groupings of functions, etc.) can be used in addition to or instead of those shown, and some elements may be omitted altogether. Further, many of the elements described herein are functional entities that may be implemented as discrete or distributed components or in conjunction with other components, and in any suitable combination and location. Various functions described herein as being performed by one or more entities may be carried out by hardware, firmware, and/or software. For instance, various functions may be carried out by a processor executing instructions stored in memory.

As shown in FIG. 1, system 100 may include, among other components, a mobile device 106, a base transceiver station (BTS) 108, a media server 110, an intermediate gateway server 112, a headend 114, a hybrid fiber coaxial (HFC) network 116, a media host device 118, a control component 120, and a display device 122. System 100 is an exemplary embodiment of the present invention showing the integration of a mobile telecommunications network 102 and a cable-television network 104, which provides a communication path between the media host device 118 and the mobile device 106. As indicated previously, although a telecommunications network is described in detail herein, other types of communications networks may be employed within the scope of the invention. Likewise, although a cable-television network is described in detail herein, other types of media-delivery networks may be employed within the scope of the invention.

The mobile device 106 may be any type of device capable of communicating wirelessly. By way of example and not limitation, the mobile device may be a cell phone, a pager, or a personal data assistant (PDA). To provide wireless service to mobile device 106, system 100 may include a BTS 108, which provides a wireless coverage area. The BTS 108 may communicate over a wireless air interface with one or more mobile devices, such as the mobile device 106, located in the wireless coverage area. The communication between the BTS 108 and the mobile device 106 may occur in a digital format, such as CDMA, TDMA, GSM, 3G, or 802.11x, or may occur in an analog format, such as AMPS.

To provide mobile device 106 access to the mobile telecommunications network 102, the BTS 108 may be coupled with a base station controller (BSC) (not shown). The BTS 108 may include a packet control function, and a packet data serving node (PDSN) (not shown) may connect the BSC to the mobile telecommunications network 102. The PDSN may then act as a network access server, providing the mobile device 106 access to the mobile telecommunications network 102. Alternatively or additionally, communications system 100 may include other network elements for providing mobile device 106 access to the mobile telecommunications network 102.

The mobile device 106 may be identified by employing any of a number of identifiers. By way of example and not limitation, the mobile device may be identified using a unique Electronic Serial Number (ESN), which is typically hard-coded into the device, a unique Mobile Identification Number (MIN), which is typically assigned to the device by a telecommunications-service provider, a special authentication key (A-key), which may be used for validating the mobile device's 106 identify, and/or a predetermined username and password. In addition, the mobile device 106 may be capable of engaging in packet-data communication and may be identified by a network address, such as an IP address. The network address may be permanently assigned to the mobile device 106 or may be dynamically assigned using a number of methods, such as a Simple IP process or a Mobile IP process.

In general, the media host device 118 may be any device arranged to receive and display analog and/or digital television content, and which is capable of communicating data to the cable-television network 104. By way of example and not limitation, the media host device 118 may be a set-top box (STB), a legacy box, an STB having an integrated cable modem, a digital video recorder (DVR), a personal video recorder (PVR), a hard disk recorder (HDR), a personal video station (PVS), a personal TV receiver (PTR) and/or an integrated terminal device, physically integral to, for example, a television.

Cable headend 114 may include an advertising insertion component 124. Advertising insertion component 124 may insert advertising targeted to particular regions serviced by cable headend 114. For example, advertising insertion component 124 might insert advertising for businesses located on the north side of a given community only to media intended to be received by viewers in the northern portion of a viewing area. Many cable television providers currently use advertising insertion components 124 to target advertising to particular regions that they service. In accordance with the present invention, as shall be described further below, advertising insertion component 124 may also insert advertising targeted to mobile users for transmission to intermediate gateway server 112 and, ultimately, media server 110 and mobile device 106. One skilled in the art will appreciate that, as used herein, "targeted" refers to advertising particularly intended for particular users, such as mobile users. While targeted advertising may be for goods and/or services of particular interest to mobile users, such as advertisements for new mobile devices or mobile device accessories, any type of advertising directed to a mobile device 106 but not to all other media users may constitute targeted advertising.

A display device 122 and a control component 120 may be communicatively connected to the media host device 118. The display device 122 may be any type of device capable of displaying television content and other data from the media host device 118. For example, the display device 122 may be a television or monitor. The control component 120 may be an infra-red remote control device sensed by the media host device 118. Other devices, such as mobile telephones, keyboards, or PDAs could provide the same functionality. The connection between the control component 120 and the media host device 118 may be wireless, such as an infra-red, radio, 802.11x, or Bluetooth connection, or directly by a cable or other physical connection such as a Universal Serial Bus (USB) connector.

Entities on the cable-television network 104 are able to communicate with the media host device 118 via the headend 114. Television content and other data may be transmitted from the headend 114 to the media host device 118 using any suitable media, such as any combination of fiber-optic and coaxial cable, making up HFC network 116. The HFC network 116 may contain a number of fiber nodes (not shown), which enable the transition between the fiber-optic and coaxial-cable portions of the network. Any number of fiber nodes may be used to convert from (i) fiber signals (carried by fiber-optic cable from the headend 114 to the fiber nodes) to (ii) RF signals (carried by coaxial cable from the fiber nodes to the media host device 118).

The headend 114 may be connected to multiple types of sources of television, media, and/or data content. The headend 114 may operate to amplify and modulate the video, audio, and data content onto a number of channels, so that the content of these sources may be received by devices, such as media host device 118. The headend 114 may also operate to transmit and receive packet data to and from devices, such as the media host device 118, via the HFC network 116. The packet-data signaling between the headend 114 and the media host device 118 via the HFC network 116 may employ an "out-of-band" signaling channel and may comply with specifications, such as "DAVIC" (Digital Audio Video Council) specifications or "DOCSIS" (Data Over Cable Service Interface Specification) specifications. Communications, such as providing program guide information, performing software updates, fault monitoring, configuration, programming, accounting, and performance monitoring, may be conducted on the out-of-band signaling channel. The out-of-band signaling channel may also be used by the media host device 118 to transmit information to the cable-television network 104, such as registration and authentication messages, requests for program guide information, and pay-per-view ordering messages.

The media host device 118 may have a MAC (Media Access Control) address, which will typically be assigned to the device by the manufacturer and will identify the media host device 118 as a unique physical device. In operation, each time the media host device 118 is powered on, it may transmit to the cable-television network 104, via the out-of-band signaling channel, a registration/authentication message, which may contain the MAC address, as well as any other data uniquely identifying and authenticating media host device 118 to the cable-television network 104. The majority of cable providers use proprietary methods of registration and authentication specific to their particular headend implementation(s) and media host device manufacturer(s); however, some standards are evolving, such as OCAP (Open Cable Application Platform). Once the media host device 118 has registered and authenticated, the cable-television network 104 may assign the media host device 118 a network address to use until the next time the media host device 118 is booted up. It is to this network address that any data bound for media host device 118 may be transmitted.

The cable-television network 104 may then associate the media host device's 118 MAC address or another identifier with the media host device's 118 assigned network address. Through this association, the customer's account then has a unique identifier associated with a unique network address on the cable-television network 104. Typically, this network address will be an IP address, and the cable-television service provider will use IP routing to transmit cable-television content and other data to the media host device 118. However, proprietary addressing schemes, such as a VPN (Virtual Private Network) or non-routable Private IP network created between the headend 114 and the media host device 118 each time the media host device 118 is powered on, may be used as well.

Media-delivery networks, such as the cable-television network 104, are typically isolated and not open to communications with other networks, such as the mobile telecommunications network 102. Therefore, in some embodiments of the present invention, such as that shown in FIG. 1, an intermediate gateway server 112 is provided to bridge between a media-delivery network, such as the cable-television network 104, and a communications network, such as the mobile telecommunications network 102. As shown in FIG. 1, the intermediate gateway server 112 resides within the headend 114 environment and is able to communicate with the headend 114 components. The intermediate gateway server 112 may communicate with entities on the mobile telecommunications network 102, such as the mobile device 106, and entities on the cable-television network 104, such as the media host device 118, thereby allowing communication between entities on the two networks. Intermediate gateway server 112 may include advertising insertion component 124 for use in inserting advertising targeted to mobile users, although advertising insertion component may exist elsewhere in system 100. However, in the case where the communication and media-delivery networks are under the control of one entity, the use of an intermediate gateway server to bridge between the two networks may not be required.

Also shown in FIG. 1 as a component of system 100 is a media server 110, which may provide a variety of functions in accordance with various embodiments of the present invention. In some embodiments, the media server 110 acts as a caching server, storing data and content from entities, such as the media host device 118, and providing the cached data and content to the mobile device 106. Media server 110 may include advertising insertion component 124 for inserting advertising targeted to mobile users. One skilled in the art will appreciate that advertising insertion component 124 may be distributed between cable head end 114 and media server 110, or may be located or distributed elsewhere in system 100. In some embodiments, the media server 110 receives media content from entities, such as the media host device 118, and provides formation conversion and conditioning to convert the content from a native format to a format acceptable to the mobile device 106. In some embodiments, the media server 110 receives media content from entities, such as the media host device 118, and streams the media content to the mobile device 106.

Exemplary Methods for Communicating Media Data to a Mobile Device

The subject matter of the present invention is described with specificity herein to meet statutory requirements. However, the description itself is not intended to limit the scope of this patent. Rather, the inventor has contemplated that the claimed subject matter might also be embodied in other ways, to include steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed.

Figure 2:
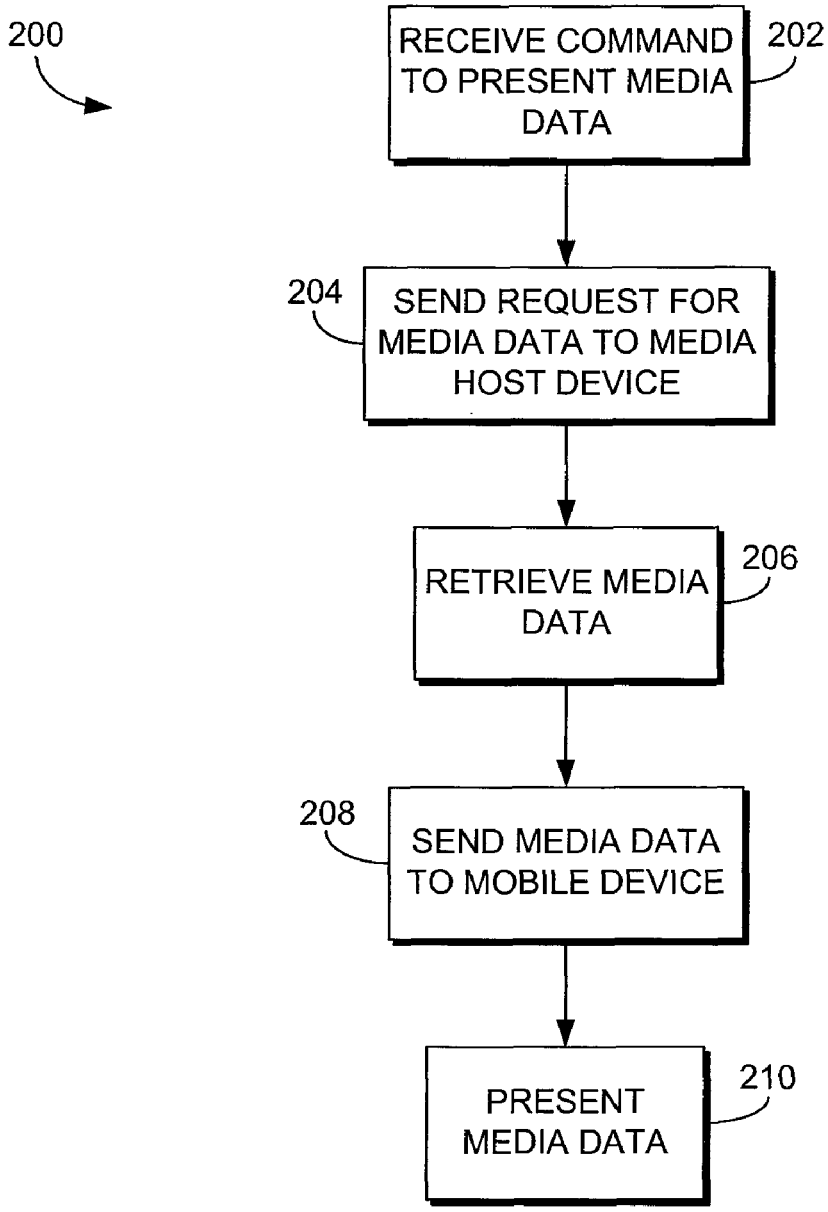
FIG. 2 is a flow diagram showing a method for communicating media data to a mobile device using the mobile device to request the data in accordance with an embodiment of the present invention.

Turning to FIG. 2, a flow diagram is illustrated which shows a method 200 for delivering media data to the mobile device 106 by using the mobile device 106 to request the media data. Media data comprises information regarding media content that is available to the media host device 118. By way of example and not limitation, the media data may be programming information (such as television guide information, pay-per-view information, and video-on-demand information), media content currently stored on the media host device 118, or media content programmed to be recorded and stored on the media host device 118. The process begins at step 202 when the mobile device 106 receives a command to present media data associated with the media host device 118. In an embodiment, the command is a user command. For example, a user may wish to view TV guide information to see what shows are scheduled for later that day, or a user may wish to view recorded information to see what media content is currently stored and available on the media host device 118.

Based on the command, the mobile device 106 sends a request for media data to the media host device 118, as shown at step 204. In an embodiment, the media host device 118 has a permanent network address, which the mobile device 106 maintains in its memory such that the mobile device 106 can direct the request directly to the media host device 118. In another embodiment of the invention, the mobile device 106 does not maintain the network address for the media host device 118, and a component, such as the intermediate gateway server 112, provides a network address translation (NAT) type function.

The network address translation may be performed by a number of methods. By way of example and not limitation, the translation may be between an identifier of the mobile device 106 and the network address of the media host device 118. In such an embodiment, the mobile device 106 sends the request to an intermediate component, such as the intermediate gateway server 112. The mobile device 106 includes with the request an identifier of the mobile device 106, such as an ESN, a MIN, an A-key, or a network address. The intermediate gateway server 112 maintains data to permit translation between the identifier and the network address of the media host device 118.

As another example, the translation may be between an identifier of the media host device 118 and the network address of the media host device 118. In such an embodiment, the mobile device 106 may maintain data relating to an identifier for the media host device 118, such as a MAC address The mobile device 106 sends a media data request, which includes the identifier, to an intermediate component, such as the intermediate gateway server 112. The intermediate gateway server 112 maintains data to permit translation between the identifier and the network address of the media host device 118.

As yet a further example, the translation may be between a user indication and the network address of the media host device 118. In such an embodiment, the mobile device user may input some indication of the mobile device 106 or the media host device 118, such as a telephone number or a username and password. The mobile device 106 sends the request, which includes the user indication, to an intermediate component, such as the intermediate gateway server 112. The intermediate gateway server 112 maintains data to permit translation between the user indication and the network address of the media host device 118.

Network address translation may also include one or more intermediate translation steps. For example, a user indication may first be translated into an identifier of the media host device 118, which is subsequently translated to the network address for the media host device 118. In addition, translation steps may occur at multiple components, and some translation steps may occur at the mobile device. For example, the mobile device may translate between a user indication and an identifier of the media host device 118 and then transmit the identifier to the intermediate gateway server 112, which translates between the identifier and the network address for the media host device 118. One skilled in the art will recognize that other methods of translation may be employed to permit communications between the mobile device 106 and the media host device 118.

After the media host device 118 receives the request for media data, it retrieves the requested media data, as shown at step 206. The retrieved media data may be either the original data or a copy of the data. Typically, the requested media data will be stored in and retrieved from the media host device's 118 memory. However, the media host device 118 may have to request the information from another source. For example, the media host device 118 may only maintain TV guide data for a day in advance of scheduled shows. Therefore, if the user requested TV guide data for two days in the future, the media host device 118 may have to retrieve the requested media data from a server maintaining the data.

At step 208, the media host device 118 sends the requested media data to the mobile device 106. In some embodiments, the request from the mobile device 106 for the media data includes the network address for the mobile device 106, such that a network address translation is not required for sending the media data from the media host device 118 to the mobile device 106. In some embodiments, the media host device 118 maintains the network address of the mobile device 106 and sends the media data without any intermediary translation. In some embodiments, translation is required to send the media data from the media host device to the mobile device 106. The translation may be similar to that discussed above for sending the request to the media host device 118. Accordingly, the translation may be based on an identifier of the mobile device 106, an identifier of the media host device 118, or a user indication.

After the mobile device 106 receives the requested media data, it presents the information, as shown at step 210. The media data may be presented on a screen integral with the mobile device 106. In another embodiment, the mobile device 106 is adapted to communicate information to a display device, similar to display device 122, which presents the media data.

Figure 3:
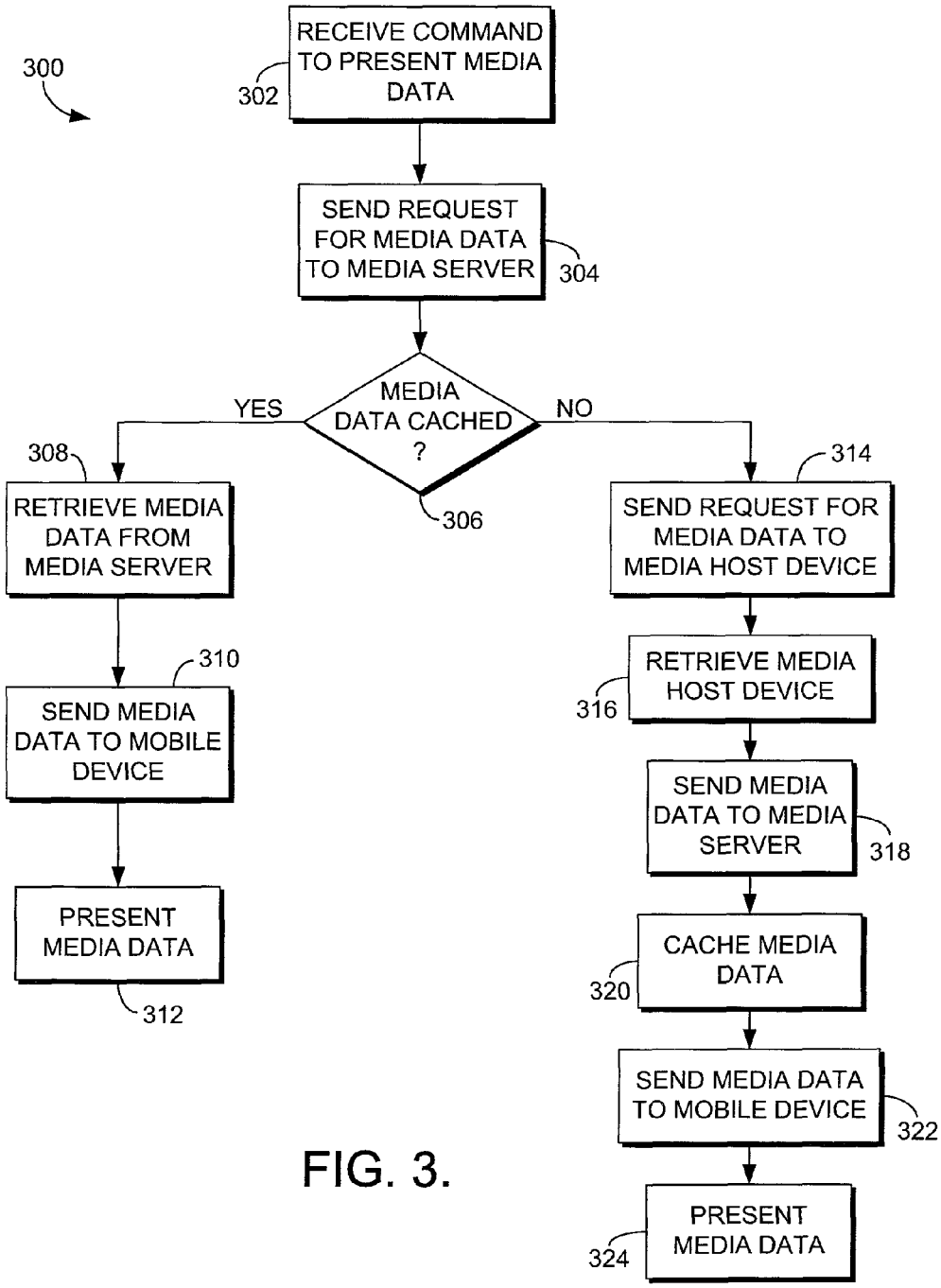
FIG. 3 is a flow diagram showing a method for communicating media data to a mobile device using a caching server in accordance with an embodiment of the present invention.

Referring now to FIG. 3, a flow diagram is illustrated that shows a method 300 for delivering media data to a mobile device 106 using a caching server. In this exemplary embodiment, the caching server may be periodically updated with media data associated with the media host device 118, thus serving as a media data source. The caching server may be updated with the media data directly by the media host device 118 or may be updated with media data by another entity. As an example of the latter, the network component that provides TV guide data to the media host device 118 may also transmit the information to the caching server.

The process begins at step 302, when the mobile device 106 receives a command to request media data associated with media host, device 118. As discussed with method 200, the command may be a user command to request the media data. At step 304, the mobile device 106 sends a request for the media data to a caching server, such as the media server 110. Although the media server 110 is discussed as the caching server in this exemplary embodiment, other network components, such as the intermediate gateway server 112 or a server not shown in FIG. 1, may be employed as a caching server.

Based on the request, the media server 110 determines whether the requested media data is cached, as shown at step 306. Because media data is associated with a particular media host device, such as the media host device 118, the request will include some method to permit identification of the particular media host device for which media data is requested. Such identification may be performed in a number of ways, such as including with the request an identifier of the mobile device 106, an identifier of the media host device 118, or a user indication.

If the requested media data is cached at the media server 110, the request media data is retrieved from the media server 110, as shown at step 308. The requested media data is then sent to the mobile device 106 at step 310. The media data is then presented on the mobile device 106 or a display device connected to the mobile device, as shown at step 312.

If the requested media data is not cached at the media server 110, the request is forwarded from the media server 110 to the media host device 118, as shown at step 314. As discussed for method 200, this may require some component, such as the intermediate gateway server 112, to perform a NAT-type function to determine the media host device's 118 network address.

At step 316, the media host device 118 receives the request for media data and retrieves the media data. As discussed for method 200, the requested media data may be embodied on the media host device 118 or the media host device 118 may need to retrieve the requested media data from another component. Once the media host device 118 retrieves the requested media data, at step 318, it sends the requested media data to the media server 110. The media server then caches the media data at step 320. By caching the media data, media server 110 can respond to future requests from the mobile device 106 for the same data (such as described with reference to steps 302 through 312) in the event that the mobile device 106 does not retain media data it receives. After caching the media data, the media server 110 sends the requested media data to the mobile device 106 at step 322. The media data is then presented on the mobile device 106 or a display device connected to the mobile device 106, as shown at step 324.

Figure 4:
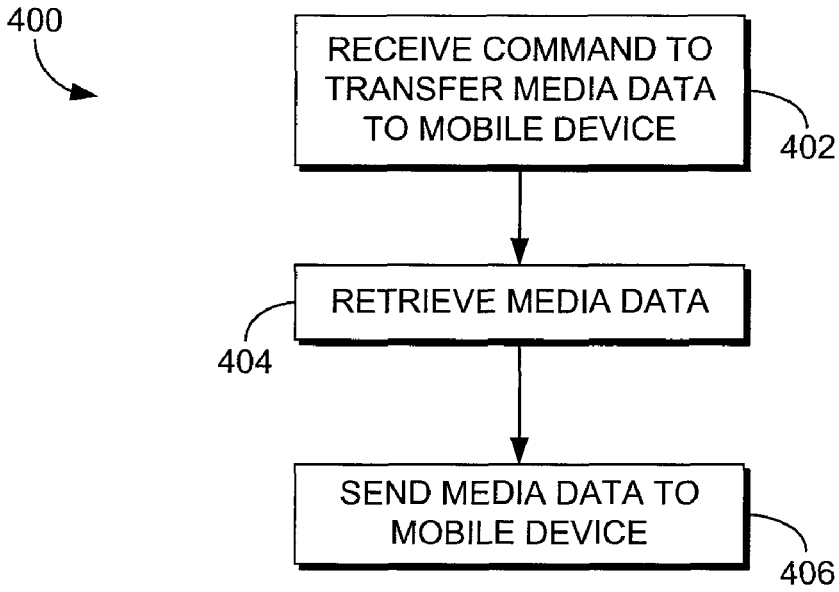
FIG. 4 is a flow diagram showing a method for communicating media data from a media host device to a mobile device in accordance with an embodiment of the present invention.

Methods 200 and 300 described exemplary embodiments in which media data is requested using the mobile device 106. In another embodiment of the invention, as shown in FIG. 4, media data may be transferred from the media host device 118 to the mobile device 106 without an initiating request from the mobile device 106. The mobile device 106 maintains received media data and may present the media data to a user when requested.

The process begins at step 402, when the media host device 118 receives a command to transfer media data to the mobile device 106. In one exemplary embodiment, the command may be a user command, whereby a user employs control component 120 to initiate the transfer of media data. In another exemplary embodiment, the command may be initiated by software embodied on the media host device, wherein the software is programmed to periodically command the media host device 118 to transmit media data to the mobile device.

Based on the command, the media host device 118 retrieves the media data at step 404. As discussed with methods 200 and 300, the media data may be embodied on the media host device 118, or the media host device may retrieve the media data from another component. After media host device 118 retrieves the media data, it sends the media data to the mobile device 106, as shown at step 406. In one embodiment, the media host device 118 maintains the network address of mobile device 106 and sends the media data using that network address. In another embodiment, the media host device 118 sends the media data to a component, such as intermediate gateway server 112, which provides NAT-type functionality to determine the network address of the mobile device 106. Similar to the translation methods previously discussed, the translation may be performed using an identifier of the mobile device 106, an identifier of the media host device 118, or a user indicator. Once the mobile device 106 receives the media data, it may cache and present the media data when requested by a user.

Figure 5:
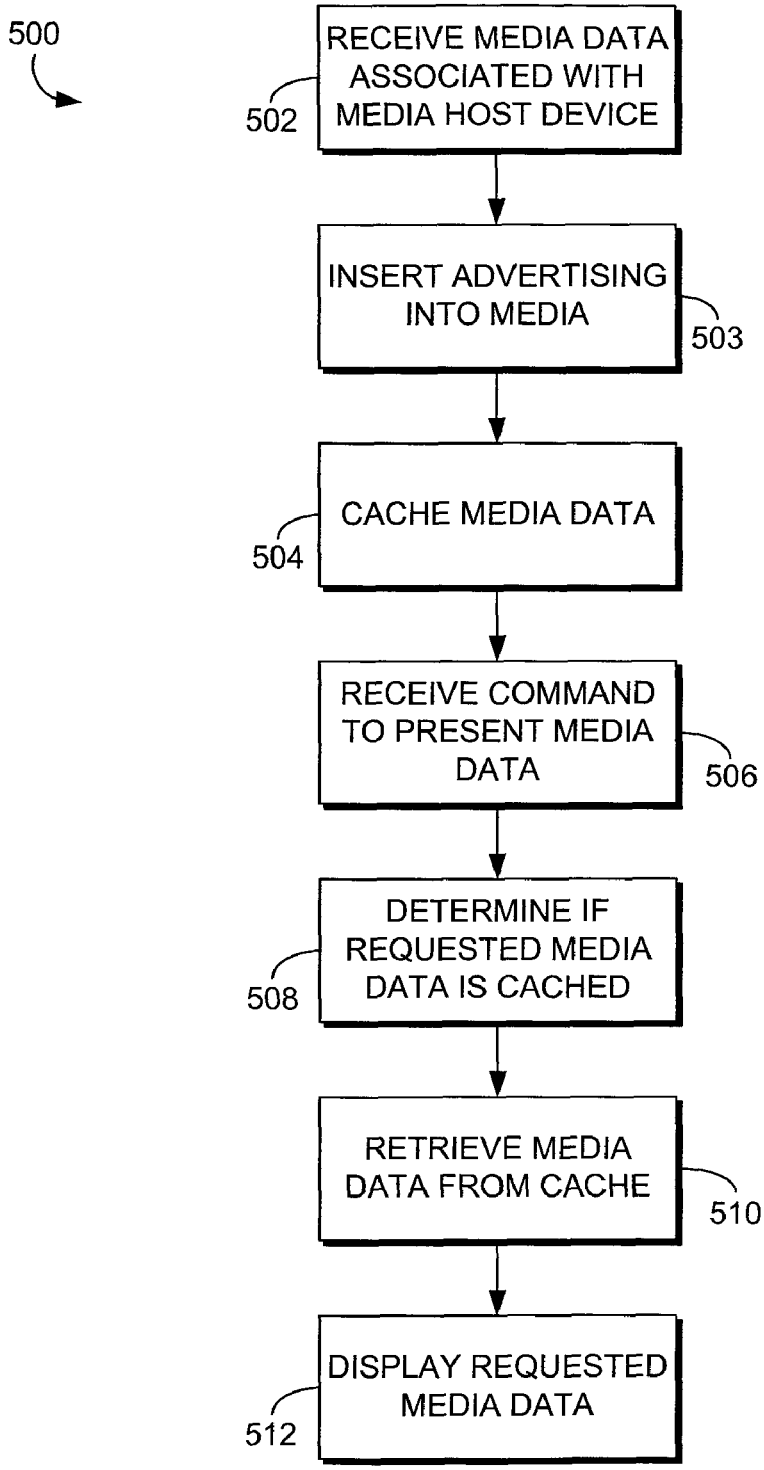
FIG. 5 is a flow diagram showing a method for receiving and caching media data at a mobile device in accordance with an embodiment of the present invention.

Referring now to FIG. 5, a flow diagram is illustrated that shows a method 500 in which the mobile device 106 and/or media server 110 receives and caches media data for later retrieval. The process begins at step 502 when the mobile device 106 and/or media server 110 receives media data. The media data may be received in response to a number of methods, including methods 200, 300, and 400. Media server 110 may also receive media to cache that duplicates media maintained on media host device 118. The mobile device 106 may also receive media data from a network component that delivers media data to the media host device 118. For example, a network component that is responsible for delivering TV guide data to the media host device 118 may also transmit the TV guide data to the mobile device 106 (directly or indirectly through another component, such as a caching server).

Advertising may be inserted into the media in step 503. The advertisement insertion step 503 may insert advertising targeted to mobile users. Advertising insertion step 503 may be performed by an advertising insertion component 124 operating in cable headend 114 generally, intermediate gateway server 112, media server 110, or elsewhere in system 100. One skilled in the art will appreciate that advertising insertion step 503 could be performed at any time in method 500 prior to displaying the requested media and that advertisement insertion step 503 is described prior to any caching in method 500 for purposes of simplicity and convenience only.

At step 504, the mobile device 106 media server 110 caches the received media data. A user may subsequently command the mobile device to present certain media data. The media data requested by the user may correspond with at least a portion of the received media data. Thus, at step 506, the mobile device 106 receives a command to present media data. At step 508, the mobile device 106 determines if the requested media data is cached. If the requested media data is cached on the mobile device 106, at step 510, the mobile device 106 retrieves the requested media data from its cache as opposed to sending a request similar to that discussed with reference to methods 200 and 300. If the requested media data is cached on media server 110, it may be requested as in method 300. At step 512, the requested media data is then presented on the mobile device 106 or a display device in communication with the mobile device 106.

Figure 6:
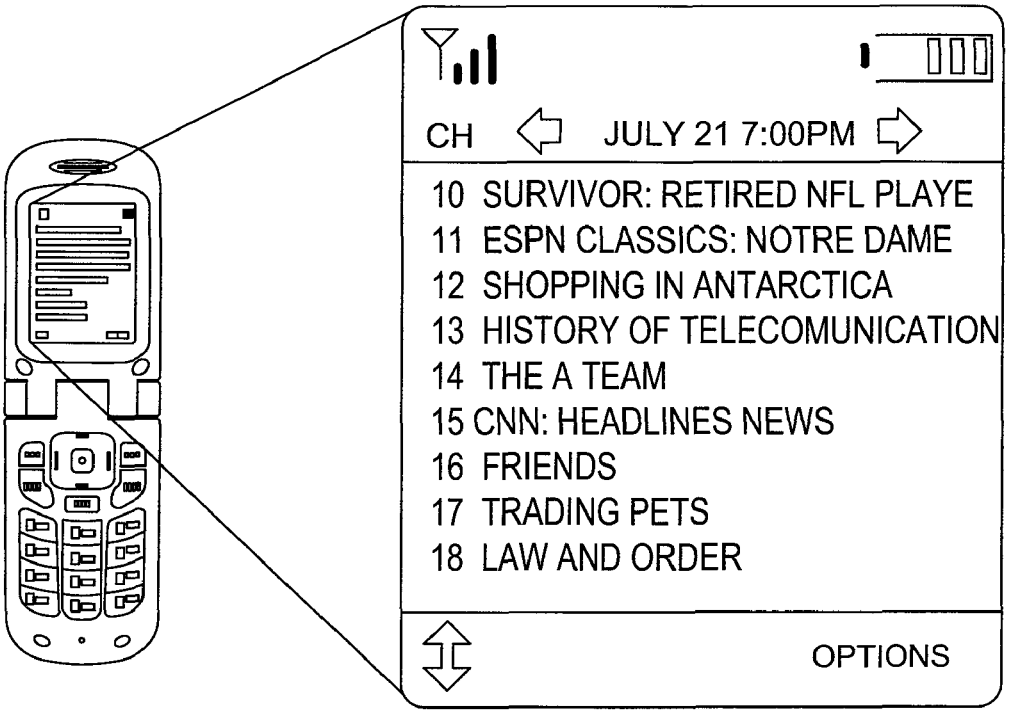
FIG. 6 is an exemplary screen shot displaying television guide data indicating television media content available to a media host device.
Figure 7:
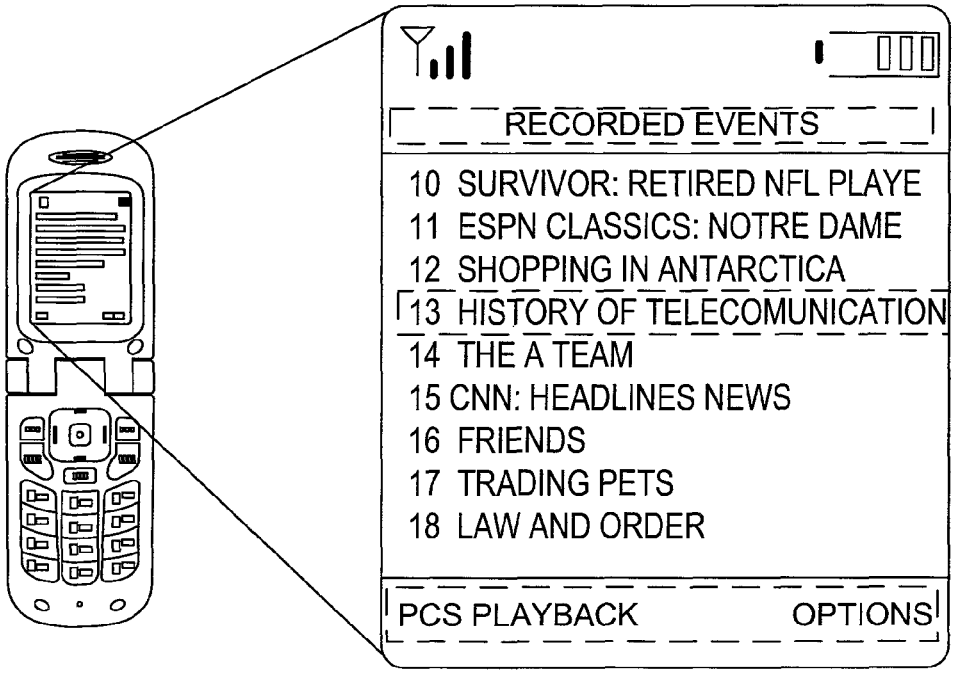
FIG. 7 is an exemplary screen shot displaying media content currently stored on a media host device.
Figure 8:
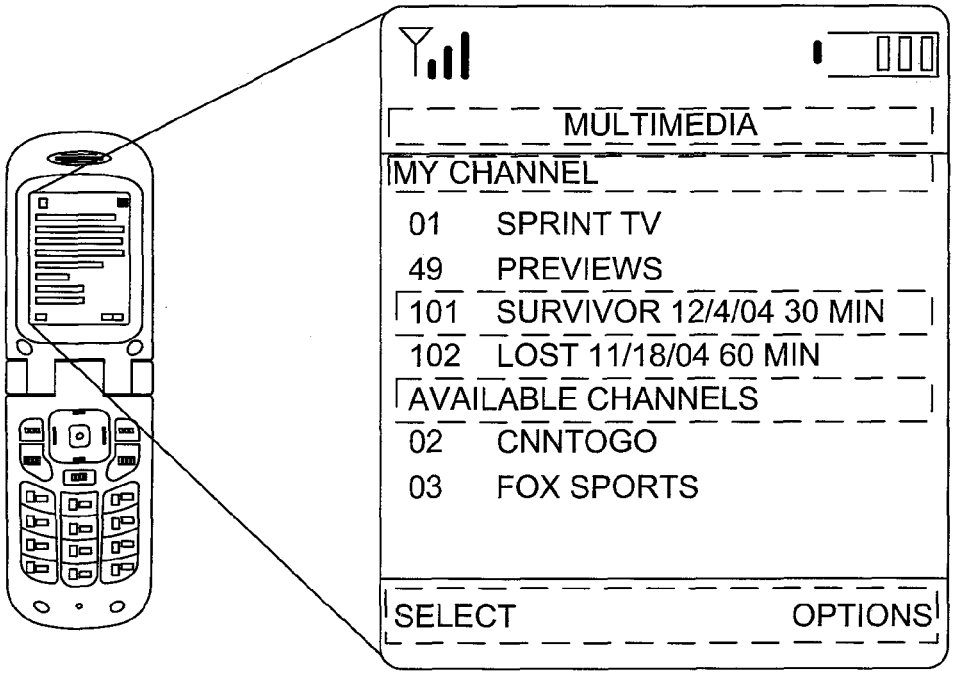
FIG. 8 is an exemplary screen shot displaying media content available to a mobile device via a media host device as well as other sources of media content.

FIGS. 6 through 8 are exemplary screen shots illustrating the presentation of media data associated with the media host device 118 on the mobile device 106 using methods of the present invention. FIG. 6 is an exemplary screen shot showing the presentation of TV guide data on the mobile device 106. The media data presented includes the date, time, and channels for various scheduled television shows. For example, the data indicates that a show titled "History of Telecommunication" is scheduled on channel 13 at 7:00 p.m. on July 21.

FIG. 7 is a screen shot illustrating the presentation of information regarding media content currently stored on the media host device 118. The information represents media content that was previously recorded by and currently available on the media host device 118.

FIG. 8 is a screen shot illustrating both media content currently stored on the media host device 118 and media content available to the mobile device 106 via sources other than the media host device 118. For example, mobile device 106 may be enabled to receive media content from a server unassociated with the media host device 118. The screen shows both the media content from other sources as well as the media content currently stored on the media host device 118.

Exemplary Method for Mobile Device Control of Media Host Device

Figure 9:
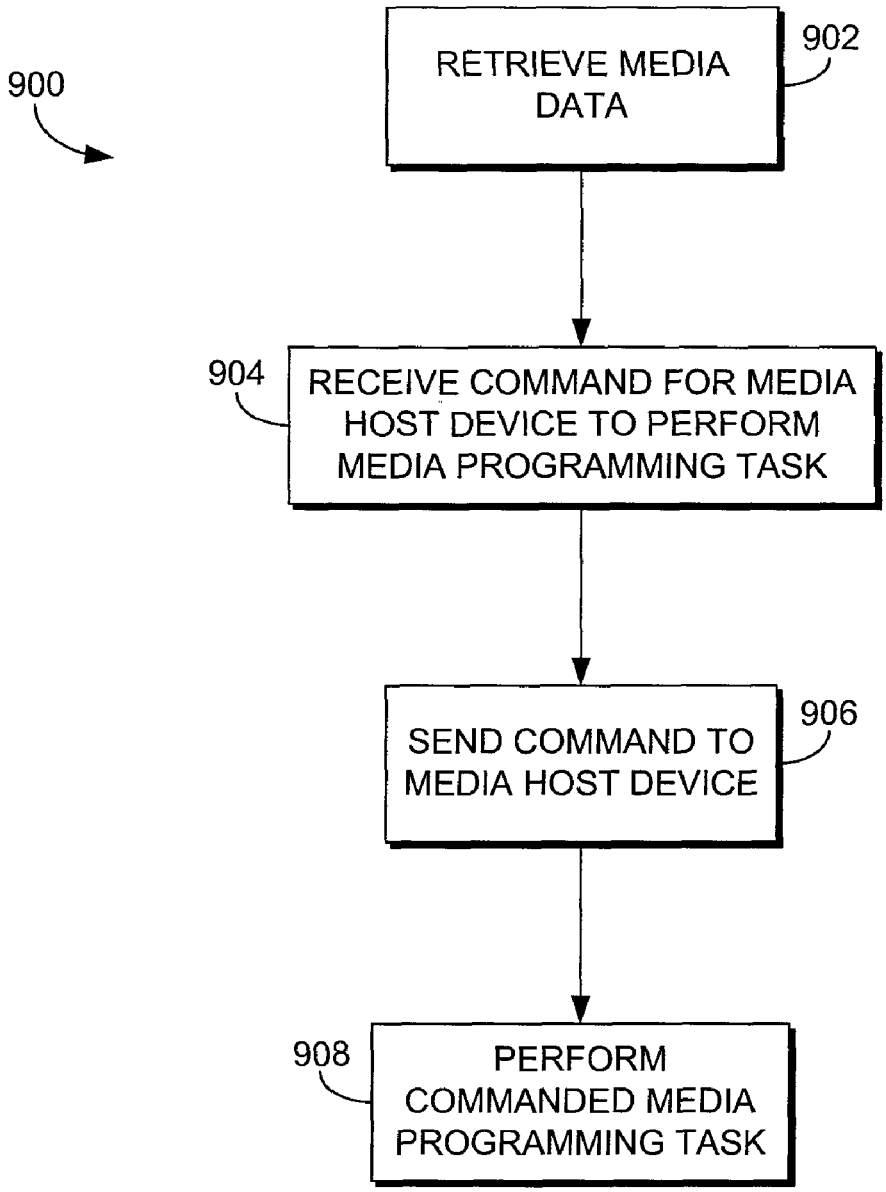
FIG. 9 is a flow diagram showing a method for controlling a media host device using a mobile device in accordance with an embodiment of the present invention.

Referring now to FIG. 9, a flow diagram is provided that shows a method 900 for using the mobile device 106 to control the media host device 118. The process begins at step 902 when media data associated with the media host device 118 is retrieved and presented on the mobile device 106. The media data may be retrieved and presented using any method, including methods 200 through 500.

At step 904, the mobile device receives a command for the media host device 118 to perform a media-programming task. A media-programming task is any type of programming or control capability of the media host device 118. By way of example and not limitation, a media-programming task may be recording a show, canceling a scheduled recording, deleting a recorded show, ordering a pay-per-view, ordering a video-on-demand, or changing the current channel tuned by the media host device 118. For example, a user may wish to record a particular show. Using TV guide data presented on the mobile device 106, such as shown in FIG. 6, the user may select a show to be recorded.

At step 906, the mobile device 106 sends the command to the media host device 118. Sending the command to the media host device 118 may or may not require network address translation. If translation is required, the translation may be performed by a number of methods, such as discussed for method 200. For example, the translation may be based on an identifier of the mobile device 106, an identifier of the media host device 118, or a user indication.

The media host device 118 receives the command and, at step 908, performs the commanded media-programming task. For example, the mobile device user may have sent a command to record a particular show. The media host device 118 receives the command and schedules the show to be recorded. The media host device 118 then records the show when it is scheduled.

After performing the media-programming task, the media host device 118 may send a verification message to the mobile device. When the mobile device 106 receives the verification message, it may present the message to alert the user that the task has been performed. Alternatively or additionally, a user may verify that the task has been performed by using the mobile device 106. For example, employing method 200 or 300, the user may request media data regarding scheduled recordings to determine that a recording has been set. Alternatively or additionally, a user of the media host device 118 may verify that the task has been performed using the control component 120 to display media data on the display device 122 connected to the media host device 118.

Exemplary Methods for Communicating Media Content to a Mobile Device

Figure 10:
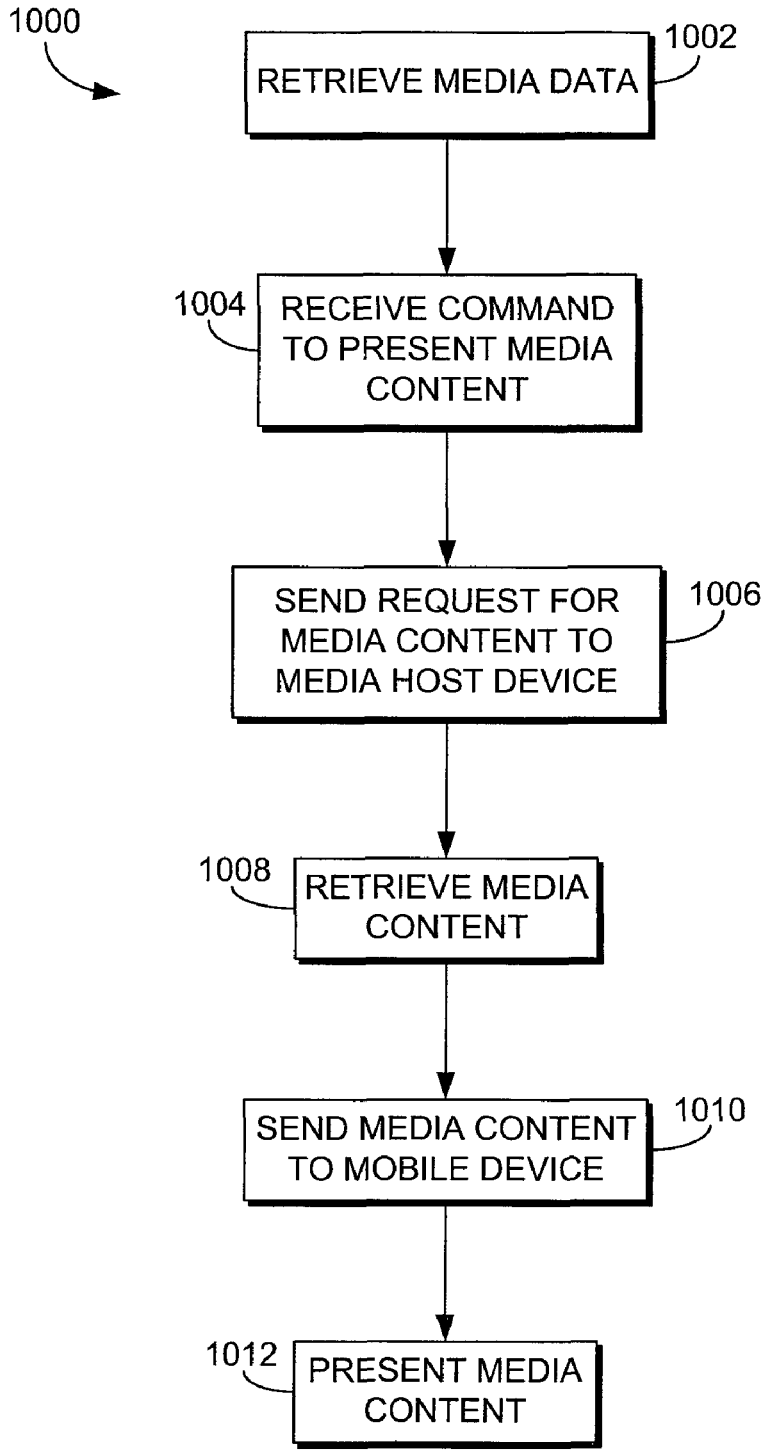
FIG. 10 is a flow diagram showing a method for communicating media content from a media host device to a mobile device based on a request from the mobile device in accordance with an embodiment of the present invention.

In embodiments of the invention, such as the exemplary embodiments shown in FIGS. 10 through 13, media content may be communicated from the media host device 118 to the mobile device 106. Referring first to FIG. 10, a flow diagram is illustrated that shows a method 1000 for transferring media content from the media host device 118 to the mobile device 106 in response to a request from the mobile device 106. The process begins at step 1002 when media data representing media content stored on the media host device 118 is retrieved and displayed on the mobile device 106. This may be accomplished by using a method, such as methods 200 through 500.

A user may then use the mobile device 106 to browse the presented media data and select media content to be transferred. Accordingly, at step 1004, the mobile device 106 receives a command to present media content from the media host device 118. Based on the command, the mobile device 106 sends a request for the media content to the media host device 118. As discussed for method 200, sending the request from the mobile device 106 to the media host device 118 may or may not require translation. If translation is required, any method may be employed, such as translation based on an identifier of the mobile device 106, an identifier of the media host device 118, or a user indication.

At step 1008, the media host device 118 receives the request and retrieves the requested media content. The media host device 118 may retrieve the actual media content embodied on the device or may retrieve a copy of the content. The media host device 118 then sends the requested media content to the mobile device 106, as shown at step 1010. The transfer may or may not require network address translation. If translation is required, any method, such as those previously discussed, may be employed.

In some embodiments of the invention, the media content requires conversion between a native format on the media host device 118 and a format acceptable for the mobile device 106. For example, the media content may reside on the media host device 118 in a 480 i or 1080 p MPEG2 format, while the mobile device 106 may only be capable of receiving and presenting content in MPEG4 format. Thus, the media content may have to be converted from the native format to the MPEG4 format. Conversion may be employed by a number of components within the scope of the invention. In one embodiment, the media host device 118 saves the media content in both formats when the media content is originally saved. In another embodiment, the media host device 118 provides format conversion after receiving a request for the media content. In some embodiments of the invention, format conversion is provided by a network component, such as the intermediate gateway server 112 or the media server 110, during communication of the media content from the media host device 118 to the mobile device 106. Format conversion may be performed by a single component or may be accomplished using multiple components. For example, the media host device 118 may provide an initial conversion, and the media server 110 may provide additional conditioning required for a particular mobile device.

In some embodiments, the media content is pushed to the mobile device 106, which caches the content. The mobile device 106 may then present the media content from its cache when requested by a user. In other embodiments, the media content is streamed to the mobile device, using a network component, such as media server 110 or the intermediate gateway server 112.

At step 1012, the media content is presented. The media content may be presented on the mobile device 106 or on a display device connected to the mobile device 106. In embodiments in which the content is pushed to and cached on the mobile device 106, the cached content is presented. In embodiments in which the content is streamed to the mobile device 106, the streamed content is presented. The mobile device 106 may be used to control the content (e.g., pausing, rewinding, fast-forwarding, etc.).

Figure 11:
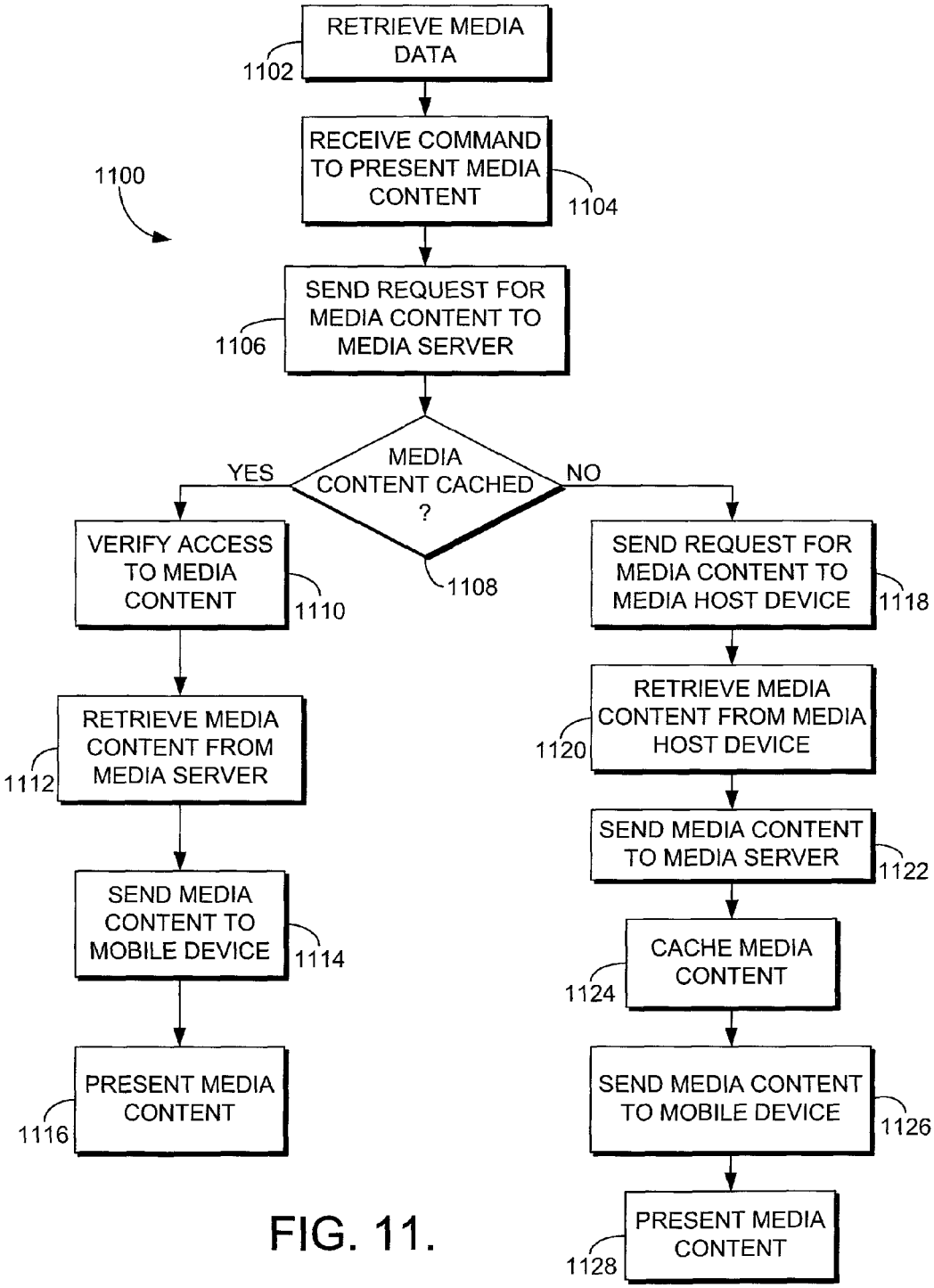
FIG. 11 is a flow diagram showing a method for communicating media content from a media host device to a mobile device using a caching server based on a request from the mobile device in accordance with an embodiment of the present invention.

FIG. 11 illustrates a flow diagram showing a method 1100, which is similar to method 1000, but employs a caching server operable to cache media content and provide cached media content to mobile device 106 when requested. The process begins at step 1102 when media data indicating what media content is currently stored on the media host device 118 is retrieved and presented on the mobile device 106. The media data may be retrieved and presented using any method, such as methods 200 through 500.

A user may then use the mobile device 106 to browse the presented media data and select media content to be transferred. Accordingly, at step 1104, the mobile device 106 receives a command to request and/or present selected media content. Based on the command, at step 1106, the mobile device 106 sends a request for the media content to a caching server, such as the media server 110. At step 1108, the media server 110 determines whether the requested media content is cached.

If the requested media content is cached on the media server 110, at step 1110, whether the mobile device 106 has access to the media content may be verified. For example, to maintain digital rights management, the media server 110 may verify access by determining that the requested media content is also currently stored on the media host device 118 or the cached content is derived from the media host device 118. If access to the cached media content is verified, the media server 110 retrieves the media content from its cache, as shown at step 1112. The media content is then sent to the mobile device 106. As discussed for method 1000, the media content may require format conversion (if it is not cached in a format acceptable to the mobile device 106). If conversion is required, the media server 110 may provide the necessary conversion. At step 1114, the media server 110 then sends the media content to the mobile device 106. The media content may either be pushed to the mobile device 106 for caching or may be streamed from the media server 112 to the mobile device 106. At step 1116, the media content is presented on the mobile device 106 or a display device connected to the mobile device 106.

If the requested media content is not cached on the media server 110, at step 1118, the media server 110 sends the request for the media content to the media host device 118. As discussed with previous methods, transferring the request to the media host device 118 may or may not require translation to determine the network address for the media host device. If translation is required it may be performed as previously discussed. After the media host device 118 receives the request, it retrieves the requested media content, as shown at step 1120. The media host device 118 then transfers the requested media content to the media server 110, at step 1122. The media server 110 caches the content, at step 1124. The content may be cached either in a native format or a format acceptable to the mobile device 106. At step 1126, the media server either pushes or streams the media content to the mobile device 106. Finally, at step 1128, the media content is presented on the mobile device 106 or a display device connected to the mobile device 106.

Figure 12:
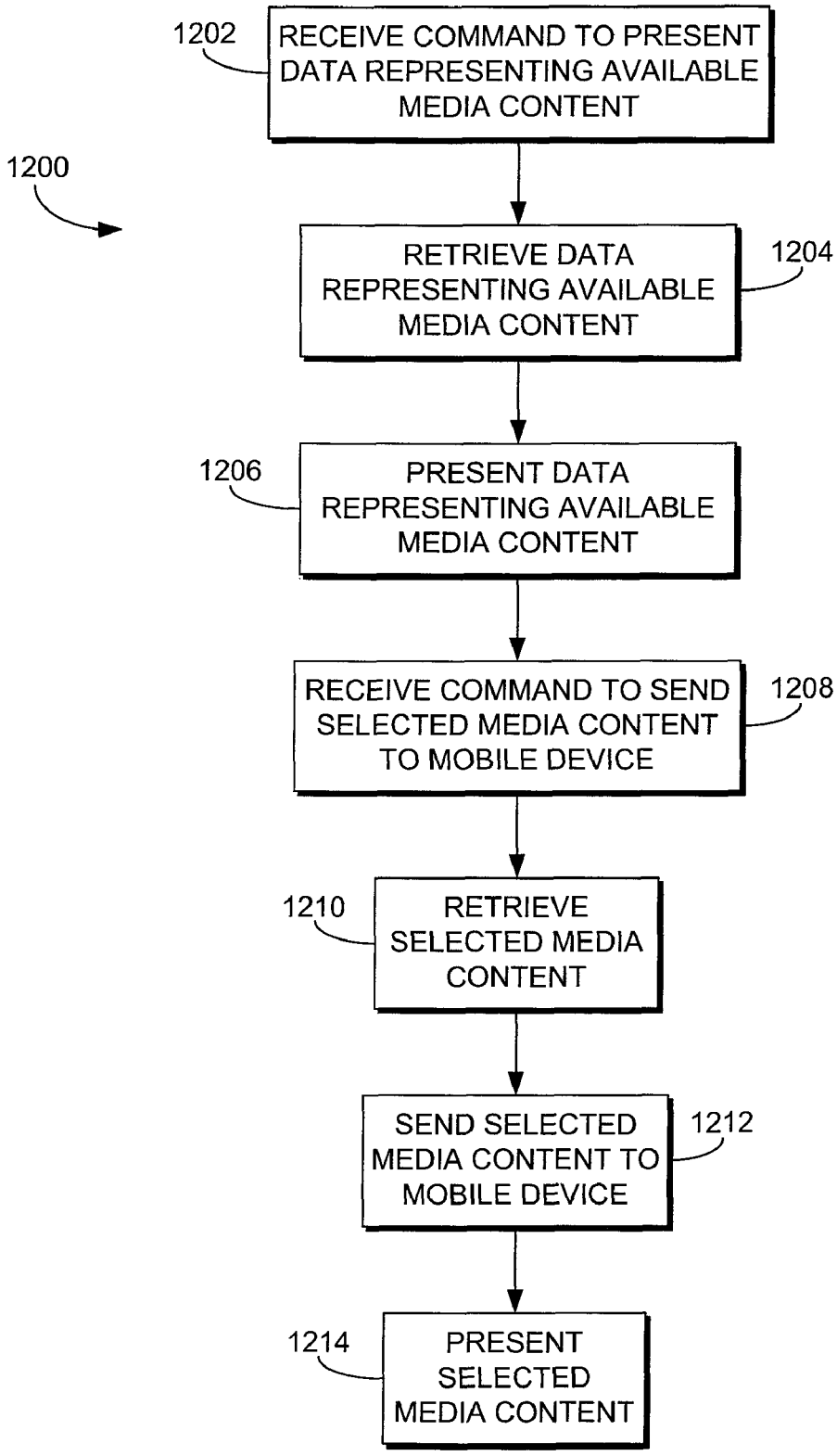
FIG. 12 is a flow diagram showing a method for communicating media content from a media host device to a mobile device in accordance with an embodiment of the present invention.
Figure 14:
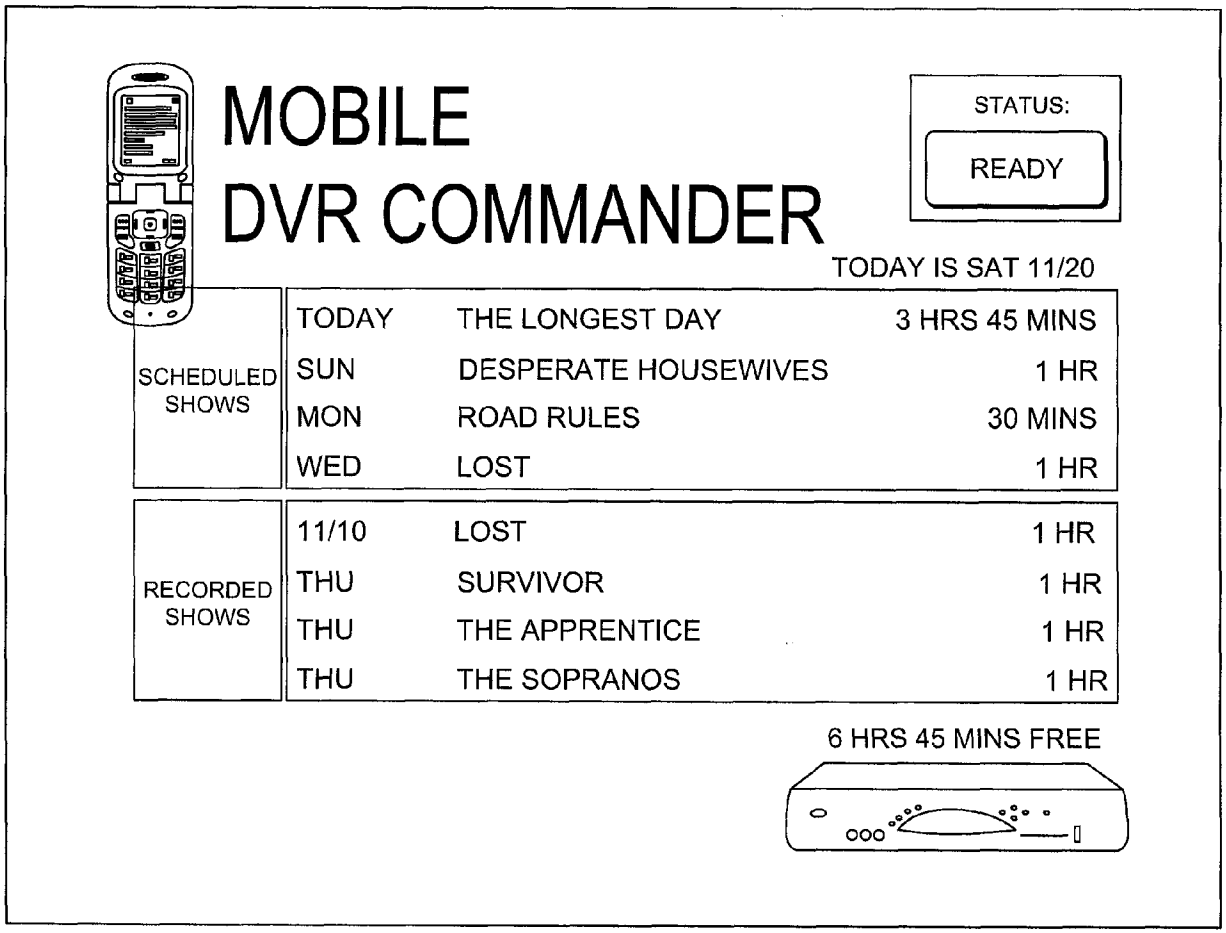
FIG. 14 is a screen shot displaying media content stored on a media host device that may be communicated to a mobile device in accordance with an embodiment of the present invention.

Referring now to FIG. 12, a flow diagram is illustrated that shows a method 1200 for using the media host device 118 to send media content to the mobile device 106. The process begins at step 1202 when the media host device 118 receives a command to present data representing media content currently stored on the media host device 118. The command may be initiated, for example, by a user employing control component 120. In response to the command, the media host device 118 retrieves the data, as shown at step 1204. The media data is then presented on the display device 122 at step 1206. A screen shot of display device 122 showing media content available to media host device 118 is shown in FIG. 14.

Using the control component 120, the user may then browse the available media content and select particular media content. Accordingly, the media host device 118, at step 1208, receives a command to send selected media content to the mobile device 106. Based on the command, the media host device 118 retrieves the selected media content, as shown at step 1210.

At step 1212, the media host device 118 sends the media content to the mobile device 106. Any required network address translation and format conversion may be accomplished as discussed previously. In addition, the media content may either be pushed to the mobile device 106 or streamed to the mobile device 106 using a network component, such as media server 110 or intermediate gateway server 112. Finally, at step 1214, the media content is presented on the mobile device 106 or a display device connected to the mobile device 106.

Figure 13:
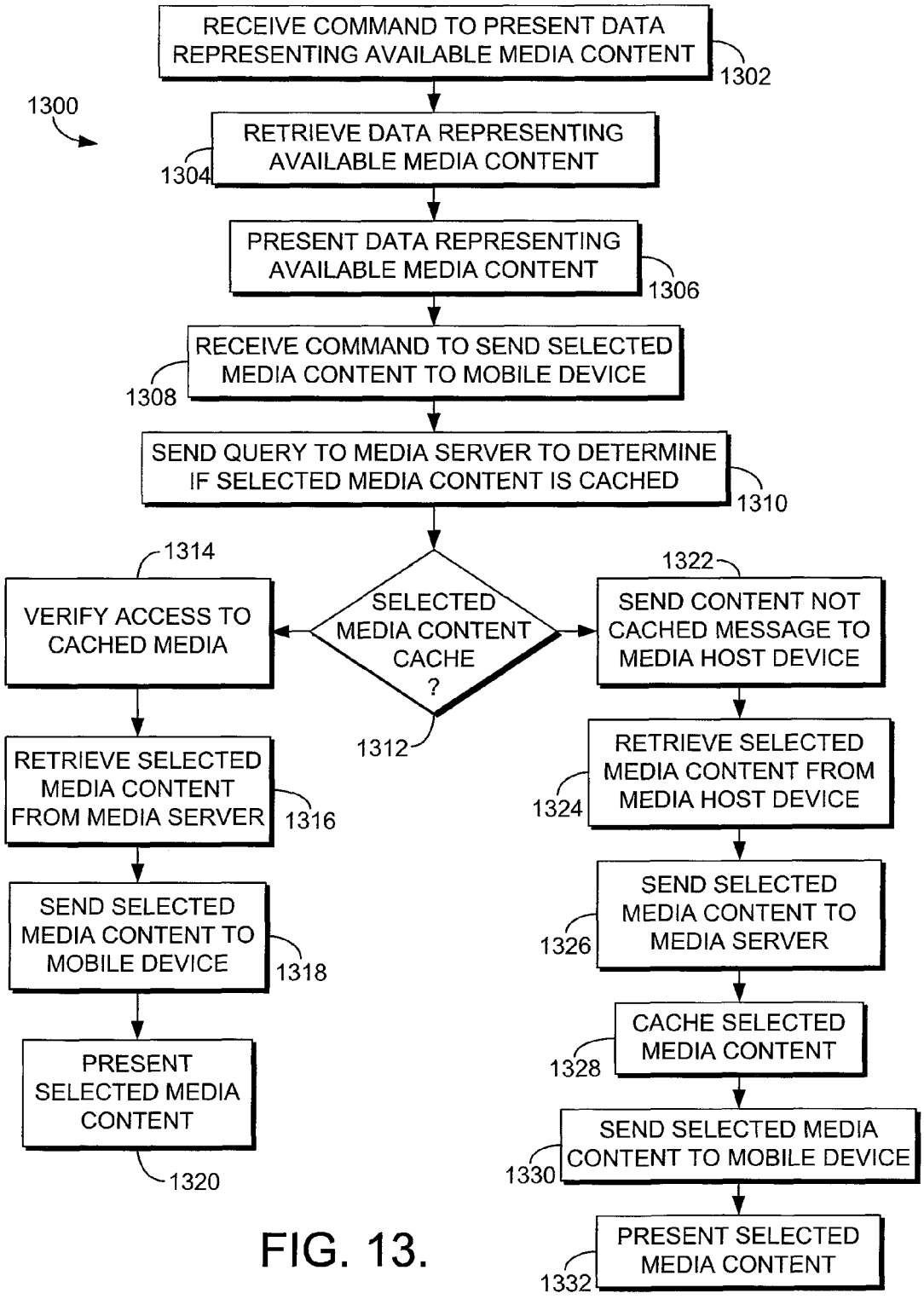
FIG. 13 is a flow diagram showing a method for communicating media content from a media host device to a mobile device using a caching server in accordance with an embodiment of the present invention.

FIG. 13 illustrates a flow diagram showing a method 1300, which is similar to method 1200, but employs a caching server operable to cache media content and provide cached media content to mobile device 106 when requested. The process begins at step 1302 when the media host device 118 receives a command to present data representing media content currently stored on the media host device 118. The command may be initiated, for example, by a user employing control component 120. In response to the command, the media host device 118 retrieves the data, as shown at step 1304. The media data is then presented on the display device 122 at step 1306.

Using the control component 120, the user may then browse the available media content and select particular media content. Accordingly, the media host device 118, at step 1308, receives a command to send selected media content to the mobile device 106. Based on the command, the media host device 118 sends a query to a caching server, such as media server 110, to determine if the selected media content has been cached, as shown at step 1310. The media server 110, at step 1312, receives the query and determines if the selected media content is cached.

If the selected media content is cached, at step 1314, the media server 110 verifies that the user has access to the cached media content to maintain digital rights management. The media server 110 then retrieves the media content from the cache, as shown at step 1316. At step 1318, the media content is then transferred to the mobile device 106, providing any necessary network address translation or formation conversion. As discussed previously, the media content may be either pushed to the mobile device 106 for caching or may be streamed to the mobile device 106. At step 1320, the selected media content is presented on the mobile device 106 or a display device connected to the mobile device 106.

If the selected media content is not cached on the media server 110, the media server 110 sends a message to the media host device 118 indicating that the media content is not cached, as shown at step 1322. The media host device 118, at step 1324, retrieves the selected media content. At step 1326, the media host device 118 sends the selected media content to the media server 110. At step 1328, the media server 110 receives and caches the media content either in a native format or a converted format. The media server 110 sends the selected media content to the mobile device 106, at step 1330, providing any necessary network address translation and format conversion. The media content may be pushed to the mobile device 106 or streamed from a component, such as the media server 110. Finally, at step 1332, the media content is presented on the mobile device 106 or a display device connected to the mobile device 106.

FIG. 14 illustrates a screen shot 1400 of an exemplary Mobile DVR Controller program. Screen shot 1400 illustrates how a screen 1410 on a mobile device 1420 may provide information regarding DVR functions. One skilled in the art will appreciate that a user may use any of a variety of input devices, such as keypads, touch-sensitive screens, joy sticks, and voice recognition capabilities, to make selections based on the information displayed in screen shot 1400.

CONCLUSION

As can be seen, the present invention and its equivalents are well-adapted to provide a new and useful method for integrating communication networks and media-delivery networks and to: (1) communicate media data associated with a media host device to a mobile device; (2) control a media host device using a mobile device; and (3) communicate media content from a media host device to a mobile device. Many different arrangements of the various components depicted, as well as components not shown, are possible without departing from the spirit and scope of the present invention.

The present invention has been described in relation to particular embodiments, which are intended in all respects to be illustrative rather than restrictive. Alternative embodiments will become apparent to those skilled in the art that do not depart from its scope. Many alternative embodiments exist but are not included because of the nature of this invention. A skilled programmer may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A method for presenting media data via a mobile device, the method comprising:

receiving a request to present media data;

receiving the media data and targeted advertising from a media data source, wherein the media data is received on a mobile device from the media data source via at least one protected network that maintains digital rights management for the media data, and wherein the media data represents information regarding media content available to a media host device, and wherein the advertising targeted to mobile device users is not inserted into media data for delivery to receivers that are not mobile devices;

inserting the targeted advertising into the media data, wherein the targeted advertising is inserted by an advertising insertion component;

caching the media data, derived from the media host device, with inserted targeted advertising via a media caching server;

sending the cached media data with inserted targeted advertising to the mobile device; and presenting the media data via the mobile device.

2. The method of claim 1, wherein receiving a request to present media data comprises:

receiving on the mobile device a command to present media data associated with the media host device; or receiving an automatically generated command to present media data including a command to present an indication that media data is available for viewing.

3. The method of claim 2, wherein receiving the media data comprises:

communicating a request for media data, wherein the request is communicated from the mobile device to the media data source through at least one protected network.

4. The method of claim 3, wherein the media data source is a caching server operable to:

receive the request for media data;

determine whether the requested media data is located on the caching server; and if the media data is located on the caching server, send the media data from the caching server to the mobile device.

5. The method of claim 1, wherein the media data source is the media host device, a caching server, a network server, or a combination thereof.

6. The method of claim 1, wherein the at least one protected network is a communications network, a media-delivery network, or a combination thereof.

7. The method of claim 1, wherein the at least one protected network comprises a mobile telecommunications network and a cable-television network coupled by an intermediate gateway server that inserts advertising data into the media data.

8. The method of claim 1, wherein the media host device is a set-top box, a legacy box, a digital video recorder, a personal video recorder, a hard disk recorder, a personal video station, a personal TV receiver, a cable-ready television, or a combination thereof.

9. The method of claim 1, wherein communicating the media data for presentation comprises:

communicating the media data to a display device communicatively coupled to the mobile device, wherein the display device presents the media data.

10. The method of claim 1, wherein the media data comprises information relating to television guide data, pay-per-view data, video-on-demand data, recorded content data, content scheduled to be recorded, or a combination thereof.

11. A method for providing targeted advertising on a mobile device, the method comprising:

receiving media data associated with and stored on a media host device via a protected media-delivery network;

inserting advertising targeted to mobile device users into the media data, wherein the advertising targeted to mobile device users is not inserted into media data for delivery to receivers that are not mobile devices;

caching the media data with the inserted advertising;

receiving at a media data source a request to communicate media data to a mobile device;

determining if the requested media data is cached;

retrieving the requested media data from a cache; and delivering the requested media data to the mobile device via a protected communications network that maintains digital rights management for the media data, wherein an intermediate gateway server provides a bridge between the protected media-delivery network and the protected communications network.

12. The method of claim 11, further comprising:

caching the requested media data prior to delivering the requested media data to the mobile device.

13. The method of claim 12, wherein inserting advertising targeted to mobile device users into the requested media data occurs prior to caching the requested media data.

14. The method of claim 12, wherein inserting advertising targeted to mobile device users into the requested media data occurs after caching the requested media data and before delivering the requested media data to the mobile device.

15. A system for presenting media data on a mobile device, the media data representing information regarding media content available to a media host device, the system comprising:

a first protected network configured to maintain digital rights management for media data having at least one mobile device coupled thereto, wherein the at least one mobile device sends a request for media data and receives media data via the first protected network;

a second protected network configured to maintain digital rights management for media data having at least one media host device coupled thereto, wherein the at least one media host device receives the request for media data and communicates the requested media data via the second protected network;

an intermediate gateway server residing within a headend component, including: an advertising insertion component that inserts advertising targeted to mobile device users into requested media data prior to transmitting the requested media data over either the first protected network or the second protected network, wherein the advertising targeted to mobile device users is not inserted into media data for delivery to receivers that are not mobile devices; and a gateway server coupled to the first and to the second protected networks.

16. The system of claim 15, wherein the first protected network is a communications network.

17. The system of claim 15, wherein the second protected network is a media-delivery network.

18. The system of claim 15, wherein the first protected network is a telecommunications network and the second protected network is a cable media-delivered network.

19. The system of claim 18, further comprising:

a caching server within the communications network that receives media content with inserted advertising from the gateway server.

* * * * *